US006681446B2

(12) United States Patent
Compagnucci

(10) Patent No.: US 6,681,446 B2
(45) Date of Patent: Jan. 27, 2004

(54) DOOR SUPPORT BRACKET PROVIDED WITH ADJUSTMENT MECHANISM

(75) Inventor: Rossano Compagnucci, Osimo (IT)

(73) Assignee: Compagnucci - S.p.A., Santa Maria Nuova (IT)

( * ) Notice: Subject to any disclaimer, the term of this patent is extended or adjusted under 35 U.S.C. 154(b) by 5 days.

(21) Appl. No.: 10/085,191

(22) Filed: Feb. 27, 2002

(65) Prior Publication Data

US 2002/0125384 A1 Sep. 12, 2002

(30) Foreign Application Priority Data

Mar. 9, 2001 (IT) ..... MC20010011 U

(51) Int. Cl.[7] ..... E05D 7/04
(52) U.S. Cl. ..... 16/236; 49/176
(58) Field of Search ..... 16/236, 237, 238; 49/176, 177, 195

(56) References Cited

U.S. PATENT DOCUMENTS

| | | | | | |
|---|---|---|---|---|---|
| 5,193,864 | A | * | 3/1993 | Coleman | 292/256.67 |
| 5,257,437 | A | * | 11/1993 | Salice | 16/239 |
| 5,548,869 | A | * | 8/1996 | Ryczek | 16/93 R |
| 5,970,660 | A | * | 10/1999 | Jacobs | 49/425 |
| 6,058,564 | A | * | 5/2000 | Purcell et al. | 16/241 |
| 2003/0041412 | A1 | * | 3/2003 | Mueller et al. | 16/236 |

* cited by examiner

*Primary Examiner*—Ramon O. Ramirez
(74) *Attorney, Agent, or Firm*—Armstrong, Kratz, Quintos, Hanson & Brooks, LLP

(57) ABSTRACT

The present invention refers to a door support bracket provided with adjustment mechanism with three adjustment options: one translating movement and two oscillating movements with respect to two Cartesian axes.

1 Claim, 3 Drawing Sheets

1
1a
1b
1c
2
2a
2b
2c
3
4
4a
4b
5
6
S

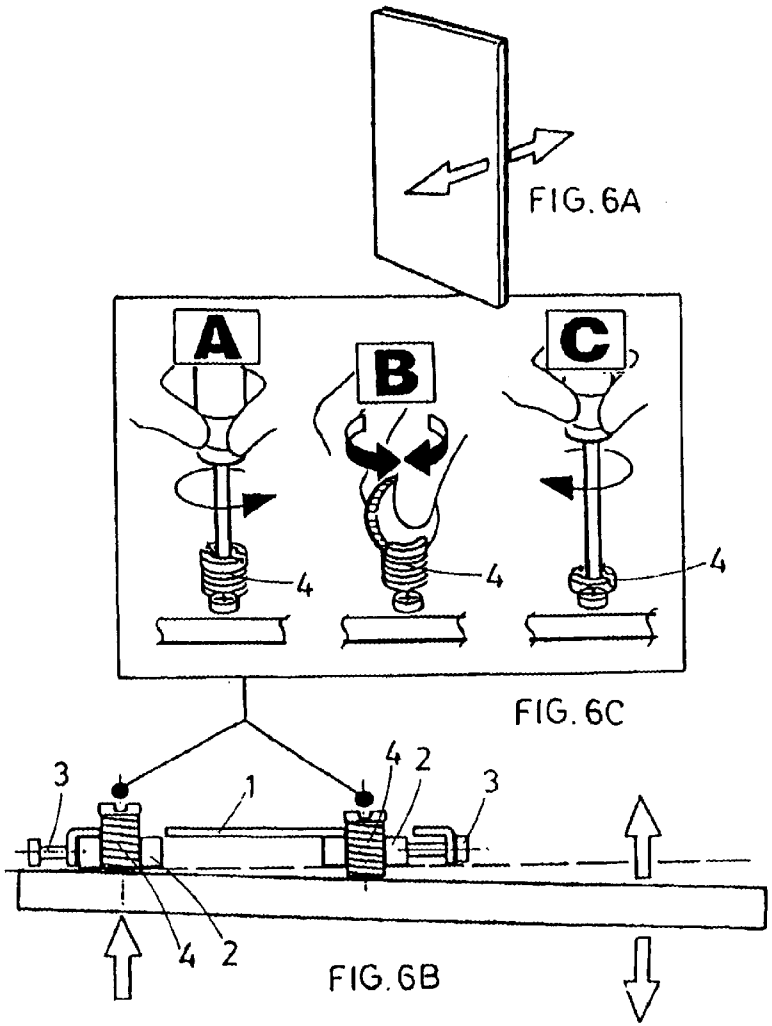
FIG. 6A
FIG. 6C
FIG. 6B
A
B
C
1
2
3
4
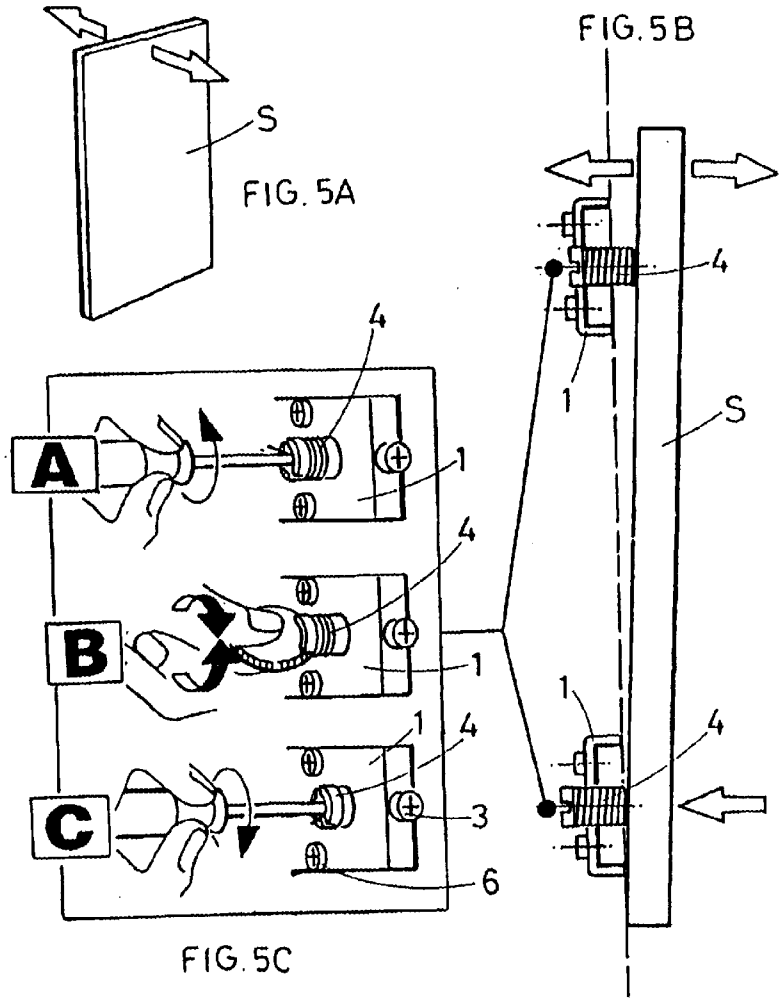
FIG. 5B
FIG. 5A
FIG. 5C
S
A
B
C
1
3
4
6

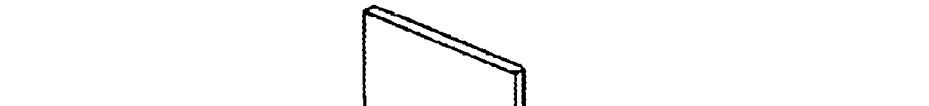
FIG. 7A
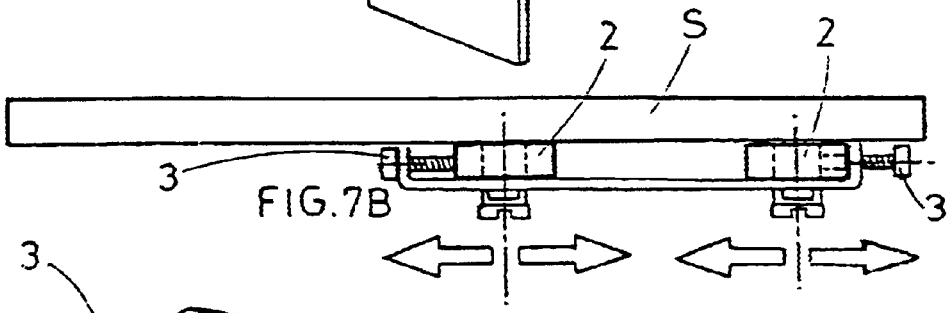
FIG. 7B
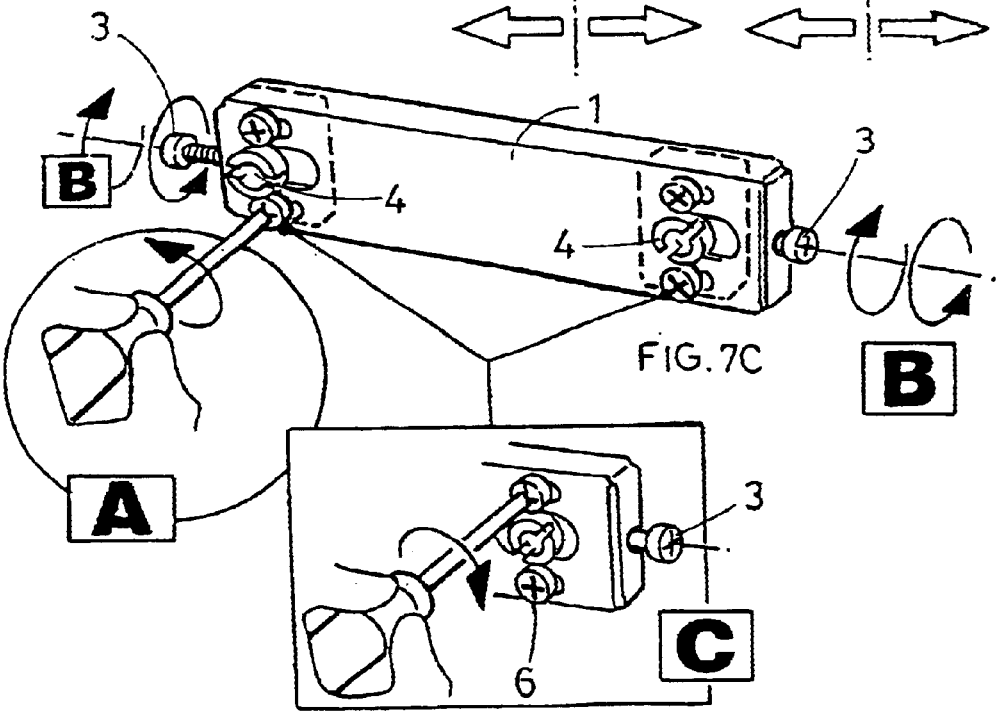
FIG. 7C
FIG. 7D

DOOR SUPPORT BRACKET PROVIDED WITH ADJUSTMENT MECHANISM

CROSS REFERENCE TO RELATED APPLICATIONS (not applicable).

STATEMENT REGARDING FEDERALLY-SPONSORED RESEARCH OR DEVELOPMENT (not applicable).

BACKGROUND OF THE INVENTION

1. Field of the Invention

The present patent application refers to a door support bracket provided with adjustment mechanism with three adjustment options: one translating movement and two oscillating movements with respect to two Cartesian axes 2. Description of Related Art The bracket of the invention has its natural field of application in the sector of modular kitchen furniture, particularly in units internally equipped with extractable drawers, formed by a metal bearing structure on which shelves, baskets, trays or similar items are anchored, according to the type or products to be contained in the drawers.

In this type of furniture the door is usually fixed to the bearing structure of the extractable unit so that the drawer is extracted from its housing when the door is open and automatically reinserted in it when the door is closed.

In view of the above, the door must be fixed to the bearing structure of the extractable drawer with means that allow to adjust the position of the door in order to align it perfectly with the other doors of the kitchen mounted using traditional hinges with ordinary adjustment means.

Doors are currently applied to the bearing structure of extractable drawers with special fixing means with adjustment mechanism, which allows the door to make short oscillating travels with respect to two Cartesian axes in order to align it perfectly with doors above, under and beside it.

However, the double adjustment mode is not sufficient, since it is often necessary to adjust the position of the door with respect to the adjacent doors, and not its vertical position. In other words, the adjustment action should allow for centering the door with respect to adjacent doors, laterally, so that the spaces between two consecutive doors have the same width.

BRIEF SUMMARY OF THE INVENTION

The purpose of the invention is to realize a door support bracket with complete adjustment mechanism, that is with three adjustment options: one translating movement and two oscillating movements with respect to two Cartesian axes.

Thanks to the translating movement the door can be moved rightwards or leftwards without altering its vertical position for perfect centering.

The bracket of the invention comprises a rectangular metal plate of box-type shape, whose ends house two runners that can translate for a short distance by means of an adjustment screw located on the two opposite sides of the box-type bracket that engage in a threaded hole located on the side of the runners.

The runners are fixed directly to the internal side of the door with a special combination of screws, which allows for moving the door forward or backwards, in parallel position.

BRIEF DESCRIPTION OF THE DRAWINGS

For major clarity the description of the bracket of the invention continues with reference to the enclosed drawings, which are intended for purposes of illustration and not in a limiting sense, whereby:

FIGS. 5A to 5C show the adjustment action that is carried out to make the door oscillate with respect to an horizontal axis.

FIGS. 6A to 6C show the adjustment action that is carried out to make the door oscillate with respect to a vertical axis.

FIGS. 7A to 7D show the adjustment action that is carried out to make the door translate rightwards or leftwards.

DETAILED DESCRIPTION OF THE INVENTION

Figures 1, 2, 3, 4:
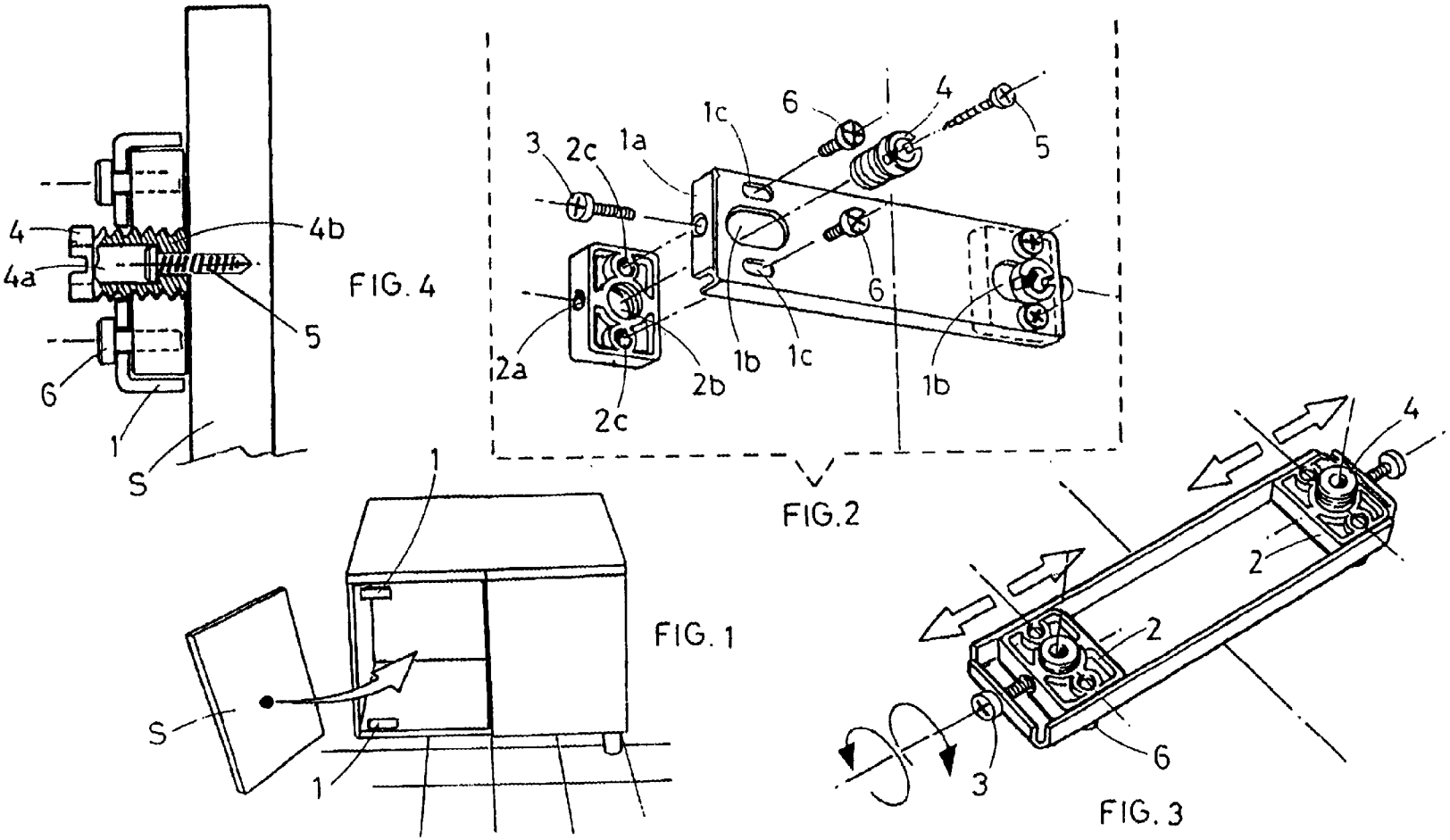
FIG. 1 is a schematic perspective view of a cabinet that housing an extractable drawer, whose bearing structure has been fixed to a pair of brackets according to the invention to support the door that closes the housing of the extractable drawer.
FIG. 2 is an exploded axonometric view of all components of the bracket of the invention.
FIG. 3 is an axonometric view of the bracket of the invention with two runners mounted on its internal side.
FIG. 4 shows the bracket of the invention applied on the internal side of a door and sectioned with a vertical plane that passes through the axis of screw used to fix each runner to the door.

With reference to FIGS. 2 and 3, the bracket (1) of the invention consists of a rectangular metal plate of box-type shape, whose ends house two runners (2) that can translate for a short distance by means of an adjustment screw (3) located on the two opposite sides (1*a*) of the box-type bracket (1) that engage in a threaded hole (2*a*) located on the side of the runners (2).

As it is shown in FIG. 4, the runners are fixed directly to the internal side of the door (S) with a special combination of screws, which allows for moving the door (S) forward or backwards, in parallel position.

More precisely, each runner (2) has a large threaded hole (2*b*) in central position, into which a special threaded dowel (4) is screwed. The dowel (4) has a blind axial hole (4*a*), whose bottom wall (4*b*) has a hole for an ordinary fixing screw (S) used to hold the dowel (4) and the runner (2) against the internal side of the door (S).

As it is shown in the drawings identified with (A) in FIGS. 5C and 6C, after loosening the screw (5), the dowel (4) can be screwed inside the support runner (as shown in the figures identified with (B) in FIGS. 5C and 6C) in order to move the door (S) closer or farther from the runner (2).

As it is shown in the drawings identified with (C) in FIGS. 5C and 6C, after placing the door (S) at the correct distance from the runner (2), it will be necessary to tighten the screw (5) again on the dowel (4) so that the dowel (4) can no longer turn inside the hole (2*b*).

Since the door (S) is supported by an overlapped pair of brackets (1) according to the invention, as shown in FIG. 1, it appears evident that the oscillation of the door with respect to an horizontal axis can be obtained by using the dowels (4) of the upper and lower brackets, as shown in FIG. 5B.

Vice versa, as it is shown in FIG. 6B, the oscillation of the door with respect to a vertical axis can be obtained by using the two dowels (4) of the same bracket (1), as shown in FIG. 7B.

Finally, the lateral movement of the door without altering its vertical position can be obtained by using the screws (3), after loosening the screws (6) that fix the runners (2) to the bracket (1).

To this end it must be said that the ends of the bracket (1) housing the runners (2) feature a series of three slots aligned in the same vertical line with respect to one another, with a larger central slot **(1*b*) between two smaller slots (1*c*)**.

The central slot **(1*a*) houses the dowel (4) that slides freely in it, while the smaller slots (1*c*) house the screws (6)** that slide freely in them.

Each runner (2) has two small threaded holes **(2*c*) above and below the hole (2*b*), in which the screws (6) are inserted through the slots (1*c*) of the bracket (1)** and tightened.

What is claimed is:

1. In a door support bracket (1) mounted on a door of a cabinet, the cabinet housing an extractable drawer, the extractable drawer having a bearing structure fixed to a pair of said door support brackets (1), the improvement comprising:

each door support bracket (1) being provided with an adjustment mechanism, each door support bracket comprising a box-shaped rectangular metal plate having opposite sides **(1*a*), the metal plate having two ends, each end of each metal plate housing a respective runner (2), a threaded hole (2*a*) being formed in a lateral position in each runner, an adjustment screw (3) being disposed in a respective opening in the side (1*a*) of the metal plate and being received in the threaded hole (2*a*)** on the respective runner;

each end of the metal plate having three aligned slots formed therein, a larger central slot **(1*b*) between two smaller slots (1*c*)**;

a threaded adjustment dowel (4) being received in the larger central slot and a respective fixing screw (6) being received in each of the smaller slots wherein said adjustment dowel and said fixing screw may slide freely laterally within the central slot and the smaller slots;

each runner having three aligned holes formed therein, a larger threaded central hole **(2*b*) between two smaller threaded holes (2*c*)**, wherein the threaded adjustment dowel is received in and cooperates with the larger threaded central hole in the runner and the fixing screws are received in and cooperate with t he smaller threaded holes in the runner such that each runner can be adjustably connected to the metal plate;

the threaded adjustment dowel further having a blind axial hole **(4*a*) formed therein, the blind axial hole having a bottom wall (4*b*) having a hole formed therein, a screw (5)** being received in the hole in the bottom wall wherein the screw is connected to an internal side of the door to the cabinet to hold the adjustment dowel and the runner to the door;

such that the door support bracket has three adjustment options.

* * * * *